United States Patent [19]

Richards

[11] Patent Number: 4,709,423

[45] Date of Patent: Dec. 1, 1987

[54] TOILET TANK DISPENSER

[75] Inventor: Randall G. Richards, Cincinnati, Ohio

[73] Assignee: The Drackett Company, Cincinnati, Ohio

[21] Appl. No.: 939,271

[22] Filed: Dec. 10, 1986

Related U.S. Application Data

[63] Continuation of Ser. No. 608,672, May 4, 1984, abandoned, which is a continuation-in-part of Ser. No. 440,126, Nov. 8, 1982, abandoned.

[51] Int. Cl.[4] ..... E03D 9/02

[52] U.S. Cl. ..... 4/228; 472/37

[58] Field of Search ..... 4/227, 228; 422/37

[56] References Cited

U.S. PATENT DOCUMENTS

| | | | |
|---|---|---|---|
| 969,729 | 9/1910 | Smith | 4/228 |
| 3,943,582 | 3/1976 | Daeninckx et al. | 4/227 |
| 4,208,747 | 6/1980 | Dirksing | 4/228 |
| 4,248,827 | 2/1981 | Kitko | 4/228 |
| 4,249,274 | 2/1981 | Kitko | 4/228 |
| 4,281,421 | 8/1981 | Nyguist et al. | 4/227 X |
| 4,305,162 | 12/1981 | Cornelisse, Jr. et al. | 4/228 |
| 4,396,522 | 8/1983 | Callicott et al. | 252/163 |
| 4,432,102 | 2/1984 | Woodruff et al. | 4/228 |
| 4,435,857 | 3/1984 | Meloy | 4/228 |
| 4,438,534 | 3/1984 | Keyes et al. | 4/227 |
| 4,451,941 | 6/1984 | Gray | 4/228 |
| 4,453,278 | 6/1984 | Doggett et al. | 4/228 |
| 4,459,710 | 7/1984 | Keyes et al. | 4/228 |
| 4,462,121 | 7/1984 | Dirksing et al. | 4/228 |
| 4,480,341 | 11/1984 | Richards | 4/228 |
| 4,485,500 | 12/1984 | Melville, Jr. | 4/228 |
| 4,507,811 | 4/1985 | Buelow et al. | 4/225 |
| 4,507,812 | 4/1985 | Dubois et al. | 4/228 |
| 4,536,367 | 8/1985 | Hung et al. | 4/228 X |

FOREIGN PATENT DOCUMENTS

| | | |
|---|---|---|
| 23092 | 7/1984 | Australia . |
| 115096 | 8/1984 | European Pat. Off. . |
| 114428 | 8/1984 | European Pat. Off. . |
| 3315873 | 10/1984 | Fed. Rep. of Germany . |
| 10110 | of 1907 | United Kingdom . |
| 2090884 | 7/1982 | United Kingdom . |

*Primary Examiner*—Charles E. Phillips
*Attorney, Agent, or Firm*—Charles J. Zeller

[57] ABSTRACT

An in-tank dispenser adapted to dispense a disinfectant solution when the toilet is flushed, the dispenser comprising a product chamber having a lower section and an upper section in fluid communication and containing a disinfectant material that releases gaseous material in aqueous solution, there being a shoulder at the interface of said sections, the cross-sectional area of the lower chamber in the plane horizontal thereto being larger than that of the upper chamber; an inlet/outlet pathway in the form of an inverted U-shaped conduit having an exterior leg and an interior leg, the uppermost portion thereof wherein the legs are joined being arcuate in shape and having a volume of less than about 0.50 cubic centimeter, said conduit being in fluid communication at the shoulder of the product chamber, the cross-sectional area normal to flow of the interior leg being less than that of the exterior leg; and vent means proximate the top of the upper section of the product chamber. The disinfectant may be selected from the group consisting of halogenated hydantoins, trichloroisocyanuric acid, and inorganic hypochlorite salts of calcium, lithium and magnesium.

14 Claims, 4 Drawing Figures

TOILET TANK DISPENSER

CROSS-REFERENCE TO PENDING APPLICATION

The present application is a continuing application of application Ser. No. 608,672 filed May 4, 1984, now abandoned, which is a continuation-in-part to U.S. patent application Ser. No. 440,126 filed Nov. 8, 1982, now abandoned.

FIELD OF INVENTION

This invention relates to a toilet tank dispenser adapted for placement in the tank of a flush toilet, the dispenser releasing a concentrated solution of a disinfectant material into the tank water as a consequence of a flush, a portion of said disinfectant solution, as diluted, being retained in the residual water of the toilet bowl after the flush. More specifically, the present invention relates to a toilet tank dispenser having a product chamber containing a disinfectant composition, which composition forms gases in aqueous solution, a refill/discharge pathway that is an inverted U-conduit, and means for directing said gases into the refill/discharge conduit, the gases that accumulate in the upper portion of said conduit isolating the concentrated solution within said chamber from the tank water during the quiescent periods between flushes. Most specifically, the present invention relates to said toilet tank dispenser wherein the gas-forming disinfecting composition contains as the disinfectant agent a material selected from the group consisting of a halogenated hydantoin, a chlorinated isocyanuric acid and calcium, magnesium and lithium hypochlorite.

BACKGROUND OF THE INVENTION

Toilet cleaning articles adapted for placement in the toilet tank of a flush toilet and further adapted to release concentrated solutions of cleaning additives in response to a change in the level of the tank water are well known. Such devices that are adapted to form an air lock in the refill/discharge means are also well known.

Thus, for example, U.S. Pat. Nos. 4,261,957 and 4,301,556, each to Schimanski and U.S. Pat. No. 4,227,853 to McDuffy disclose dispensers comprising a basket to receive a solid cake or bar containing the active cleaning constituents, the basket having a plurality of holes for the intake and outflow of liquid.

U.S. Pat. Nos. 650,161 to Williams, et al., and 1,175,032 to Williams disclose dispensers provided with siphon means adapted to withdraw a given volume of solution from the dispenser. In these dispensers the inverted U-shaped siphon conduit extends well into the solution chamber, the cross-sectional area of said siphon tube to the cross-sectional area of the chamber being very small. Similar dispensers are disclosed in U.S. Pat. No. 969,729 to Smith and U.K. Pat. Nos. 1O,11O (1907) to Holloway; 2,125 (1908) to Berry; and 11,469 (1890) to Fleuss.

U.S. Pat. Nos. 4,171,546; 4,186,856, and 4,208,747 each to Dirksing; 4,251,012 to Owens, et al.; 4,281,421 to Nyquist, et al.; 4,216,027 to Wages, and U.K. Patent Application No. 2,090,884A each disclose passive dispensers wherein the product chamber solution is isolated from the tank water during quiescent periods by means of an air lock. In the '546 patent, the air lock is provided in the top of the chamber and straddles both an inlet conduit and an outlet conduit, the solution contained in the product chamber being evacuated therefrom through the discharge conduit in view of a pressure differential between the interior of said chamber and the atmosphere. The '856 patent operates in like manner, the dispenser having, however, an interior measuring cavity within the dispenser, said measuring cavity having a water inlet port. In the '747 patent, the dispenser comprises a product chamber, a reservoir for containing a quantity of the additive product solution, an inlet/discharge conduit having its lowermost end in fluid communication with the reservoir and its uppermost end in fluid communication with a siphon tube, an air trap disposed adjacent the inlet/discharge conduit, and an air vent in fluid communication with the reservoir and product chamber. During the filling of the '747 dispenser, tank water enters the siphon tube displacing air into said air trap, the entrapped air, after filling is complete, repositioning itself to the top of the siphon tube.

The '884A British Application discloses a dispensing device comprising an upper chamber with port means in fluid communication with the tank water, a lower chamber, serpentine first conduit means between said upper and lower chambers, an air lock being formed during refill in the serpentine conduit means, and inverted U-shaped conduit means disposed from the top of the lower chamber, an air lock being formed in the U-shaped conduit means during refill. In operation liquid in the upper chamber flows into the lower chamber in view of the head differential between the liquid in the dispenser and the tank water level, the liquid in the upper chamber displacing the solution in the lower chamber. The air lock in the serpentine conduit isolates the upper and lower chambers, and because the liquid in the upper chamber is substantially devoid of any solute, migration of solute from the upper chamber does not occur. In view of the air locks associated with each conduit, migration of solute or solution from the lower chamber also does not occur.

SUMMARY OF THE INVENTION

It is an object of the present invention to provide a dispenser for placement in a toilet tank, the dispenser releasing into the tank a concentrated solution each time the tank is flushed.

It is a primary object of the present invention to provide a dispenser which substantially isolates the solution contained within the dispenser from the tank water during quiescent periods. In this regard, the dispenser of the present invention is adapted to direct gases formed in aqueous solution by the disinfectant composition to the siphon conduit for retention therein.

It is an additional object of the invention to provide a dispenser that substantially prevents the release of gases formed by the disinfectant composition into the tank water during quiescent periods. These and other advantages and objects of the present invention will be readily apparent upon a reading of the specification, a summary of which follows.

The dispenser of the present invention comprises a product chamber for containing a disinfectant composition, said composition forming gases in aqueous solution over time, the product chamber having a lower portion and an upper portion, the upper portion being of smaller width such that a shoulder is formed at the top of said lower portion, a refill/discharge pathway in the form of an inverted U-conduit, the interior leg of said conduit entering the product chamber at said shoulder, and vent means proximate the top of said upper portion. Preferably, the refill/discharge pathway is a siphon conduit, the exterior leg thereof being longer than said interior leg.

The disinfectant composition suitable for incorporation in the dispenser of the present invention comprises a disinfectant material that forms gases in aqueous solution over time. Suitable disinfectant materials may be selected from the group consisting essentially of 1,3-dichloro-5,5-dimethyl hydantoin; 1,3-dibromo-5, 5-dimethyl hydantoin; 1-bromo-3-chloro-5,5-dimethyl hydantoin; trichloroisocyanuric acid, and inorganic salts of hypochlorites, for example, calcium, lithium and magnesium hypochlorites.

The disinfectant composition is preferably provided in the lower portion of the product chamber, and gases formed therein rise through the disinfectant solution, a portion of the evolved gas impinging upon the shoulder, said shoulder thereby facilitating the accumulation of gas within the refill/discharge pathway, the accumulated gas within the pathway forming a gas barrier preventing diffusion of disinfectant during quiescent periods.

DETAILED DESCRIPTION OF THE PREFERRED EMBODIMENT

Figure 1:
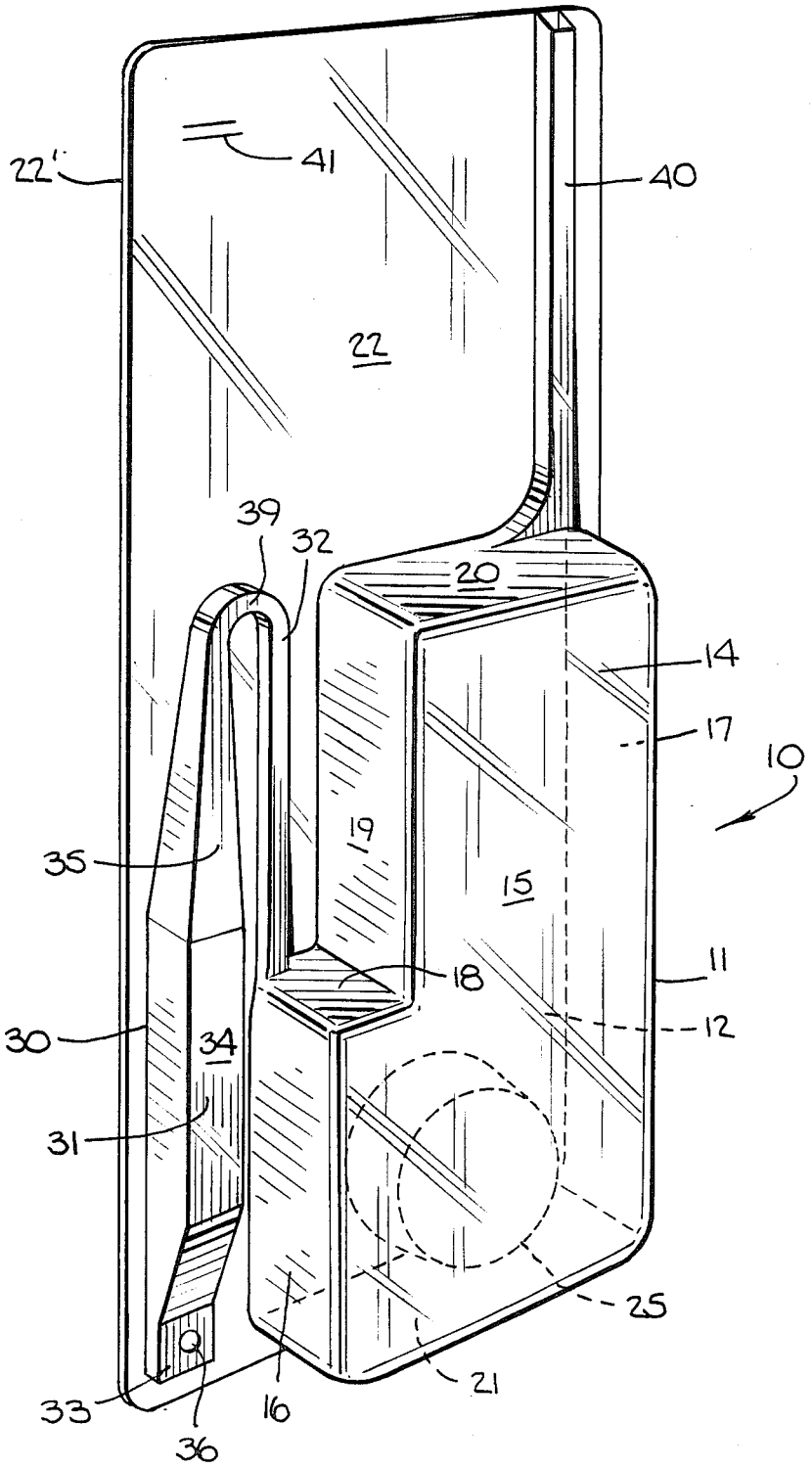
FIG. 1 is a perspective view of a first embodiment of the dispenser of the present invention.

Referring to FIG. 1, the dispenser 10 of the present invention comprises a product chamber 11 having the lower portion 12 for containing a disinfectant composition hereinafter described and an upper portion 14, the volume of which is essentially equal to the volume of solution discharged from the dispenser, a refill/discharge pathway 30 which is an inverted U-conduit, and a vent 40, which is shown to extend from the top of the product chamber 11. Preferably, the dispensing article herein is fabricated by thermoforming a first thermoplastic resin substrate 22 to provide the product chamber, refill/discharge pathway, and vent, respectively, filling the product chamber with the disinfectant composition, and securing to the back of the substrate 22 a backing substrate 22'. Other suitable methods of fabrication can be used, for example, injection molding.

Common to the upper and lower portions of the product chamber 11 is front wall 15, the back wall which is the backing substrate 22', and side wall 17. The lower portion 12 of the product chamber 11 further comprises bottom wall 21, side wall 16, and top wall segment 18, while the upper portion 14 of the product chamber 11 further comprises top wall 20 and side wall 19. The refill/discharge conduit 30 comprises a long leg 31 and a short leg 32, the legs 31 and 32 being arcuately joined at their uppermost portions, said arcuate portion being designated by numeral 39 the short leg 32 being in fluid communication with the lower portion 12 of the product chamber 11 at the top wall segment 18, which wall segment 18 is hereinafter referred to as the shoulder 18. Preferably, the uppermost portion 39 of the refill/discharge pathway 30 is at a level that is at or is slightly below that of the top wall 20 of the upper portion 14 of the product chamber 11.

Preferably, the long leg 31 of the refill/discharge pathway 30 comprises an end portion 33 having an orifice 36 proximate the bottom thereof, a middle portion 34 of larger horizontal cross-sectional area than said end portion 33, and a top portion 35 of progressively smaller cross-sectional area than that of the middle portion 34. The cross-sectional area of the short leg 32 is essentially constant through its height, and is smaller than that of the top portion 35 of the long leg 31. The uppermost portion 39, which is in transition between said top portion 39 of leg 31 and leg 32, has a decreasing cross-sectional area normal to the flow path of fluid. The product chamber 11 is vented by means of conduit 40 extending from the top wall 20 of the upper portion to the periphery of the elastic substrate 22. Preferably, indicia 41 is provided to advise the consumer of the proper placement of the dispenser 10 in the toilet tank, which is above top wall 20 of the product chamber 11.

The disinfectant composition 25 is provided in the lower portion 12 of product chamber 11 and may be in tablet, pouch, agglomerate, briquette, or cake form, the composition containing a disinfectant material selected from the group consisting of 1,3-dibromo-5,5-dimethyl hydantoin; 1,3-dichloro-5,5-dimethyl hydantoin, 1-bromo-3-chloro-5,5-dimethyl hydantoin, trichloroisocyanuric acid, calcium hypochlorite, lithium hypochlorite, and magnesium hypochlorite. A preferred disinfectant material comprises a mixture of 2 to 4 parts trichloroisocyanuric acid to 1 part cyanuric acid.

Common to these disinfectant materials is their ability in aqueous solution to evolve gaseous by-products, such as nitrogen, carbon dioxide, chlorine, and mono-, di-, and trichloramines.

The precise composition of the gas evolved depends on the particular disinfectant material. In the case of the hydantoin disinfectant materials, high levels of nitrogen are evolved, while for the trichloroisocyanuric acid, the majority of the gas evolved is carbon dioxide with lesser amounts of nitrogen, trichloramine, and chlorine.

The rate of evolution also varies with respect to the particular disinfectant material. A tableted composition containing trichloroisocyanuric acid was found to evolve gas at a rate of from about 0.029 to about 0.069 cc/g/hr in a 24-hour period, 0.12 cc/g/hr in a 48-hour period, and 0.07 cc/g/hr in a 144-hour period. For a composition containing 3 parts trichloroisocyanuric acid and 1 part cyanuric acid, the rate of gaseous evolution being 0.006 cc/g/hr after 24 hours and 0.016 cc/g/hr after 48 hours. With this formulation there appears to be a leveling off of the evolution rate after 48 hours, the rate after 72 hours being 0.019 cc/g/hr, and after 240 hours, 0.018 cc/g/hr.

The volume required to create the gas barrier across the arcuate portion 37 of the refill/discharge conduit should be, by proper dimensions of the arcuate portion, less than about 0.5 cc and, preferably, less than about 0.25 cc. Thus, it is seen that the amount of gas liberated per hour per gram provides sufficient gas to provide the requisite gas barrier, which should form in less than 24 hours.

As will be discussed below, formation of the gas barrier within a 24-hour period is sufficient to prevent the accumulation of disinfectant ions in the tank water at high concentrations. Typically, unacceptable levels of disinfectant ion concentration are obtained after several days of inactivity with a dispenser not provided with means to prevent the migration of the disinfectant solution.

Figure 2:
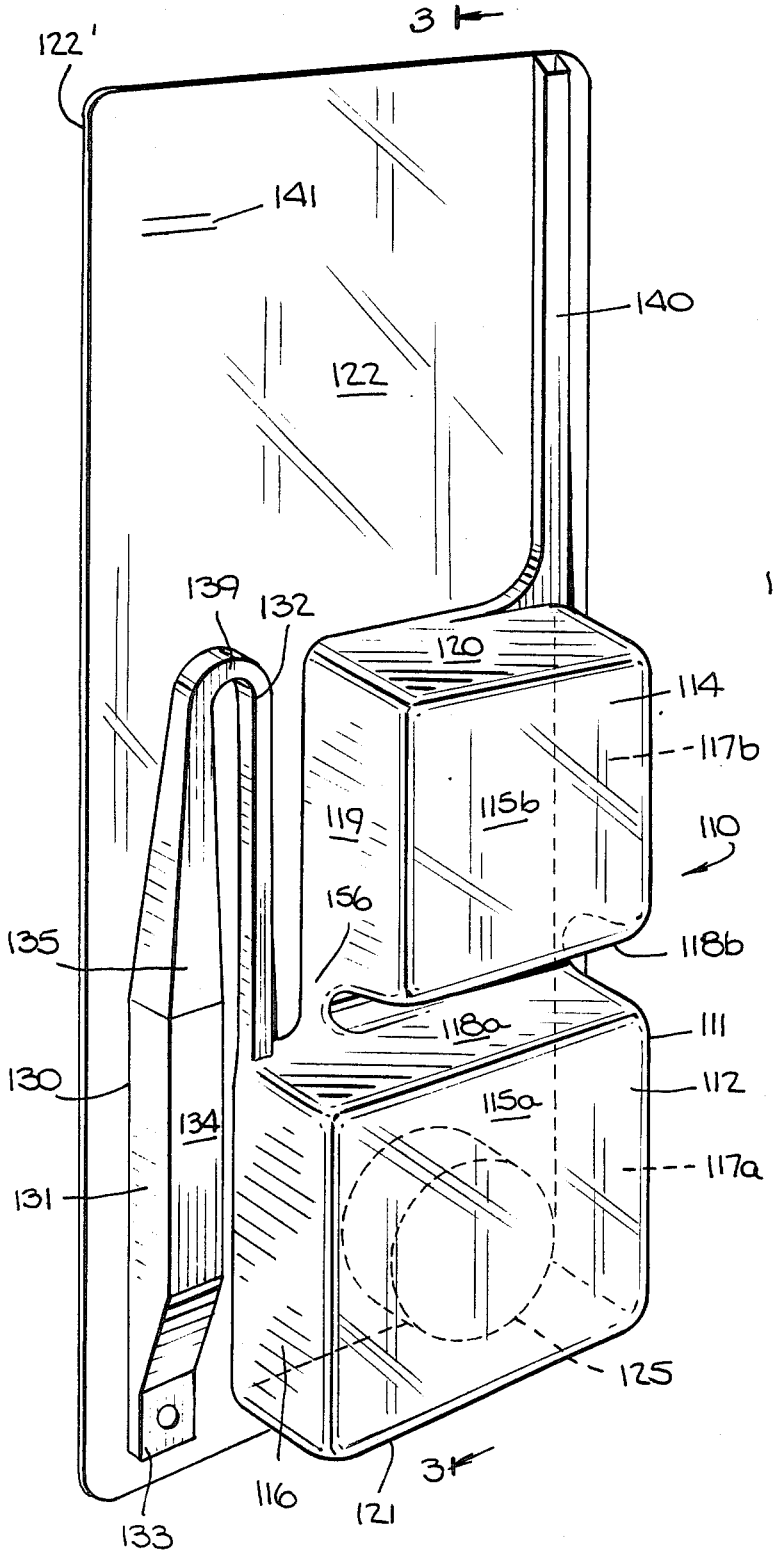
FIG. 2 is a perspective view of a second embodiment of the dispenser of the present invention.

The embodiment shown in FIG. 1 is preferred with disinfectant compositions that evolve large amounts of gas, a major portion of the gas evolved bypassing shoulder 18 and going to the upper portion for venting through vent 40. Such disinfectant materials are calcium hypochlorite and lithium hypochlorite. FIG. 2 is a second embodiment of the dispenser of the present invention, this embodiment being preferred for use with disinfectant compositions that evolve less amounts of gaseous by-products, such disinfectant composition containing the aforesaid halogenated hydantoins and trichloroisocyanuric acid. This embodiment is particularly preferred with regard to a disinfectant composition containing 2 to 4 parts trichloroisocyanuric acid and 1 part cyanuric acid.

Referring to FIG. 2, the dispenser 110 comprises a product chamber 111 having a lower portion of 112 and an upper portion 114; a refill/discharge pathway 130, and a vent 140. The lower portion 112 has front wall 115*a*, side walls 116 and 117*a*, bottom wall 121, and top wall segment 118*a*. The upper chamber 114 has a front wall 115*b*, side walls 117*b* and 119, top wall 120, and bottom wall segment 118*b*. The back wall which is the planar backing substrate 123 is common to both upper and lower portions of the product chamber 111. As shown in FIG. 2, the disinfectant composition is provided in the lower portion 112 of product chamber 111, although this is not essential where the solution formed tends to form a density-concentration gradient. Thus, a 1-bromo-3-chloro-5,5-dimethylhydantoin tablet provided in the upper portion 114 of the product chamber 111 forms a solution in the dispenser 110 that has its highest concentration of solute in the lower portion 112, the gases evolved in the lower portion 112 forming the gas barrier in arcuate portion 139 in accordance herewith.

Figure 3:
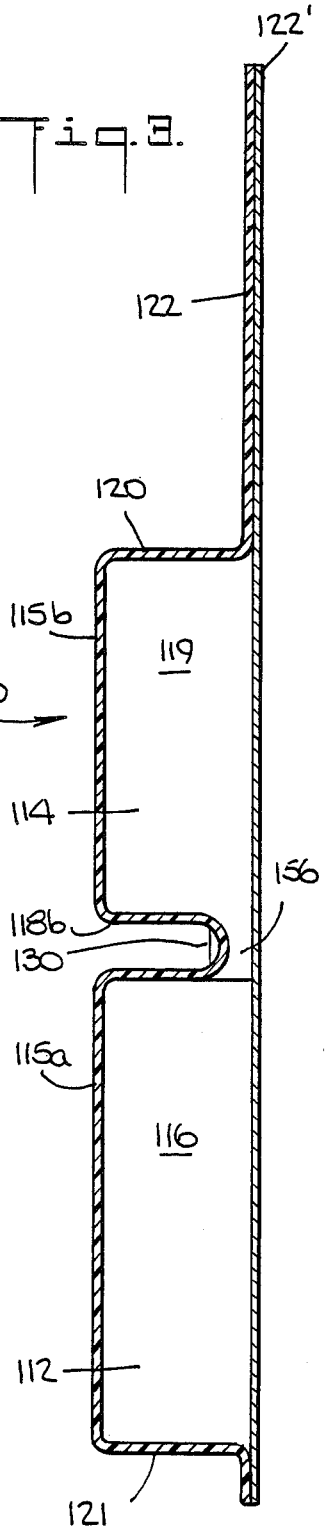
FIG. 3 is a cross-sectional side elevational view through lines 3—3 of FIG. 2.

As most clearly shown in FIG. 3, a cross-sectional view of the product chamber across line 3—3 of FIG. 2, the top wall segment 118*a* and bottom wall segment 118*b* extend only partially into the depth of the product chamber normal to the backing substrate, thus providing an elongate path or channel 156 for fluid communication between the lower portion 112 and upper portion 114 of the product portion 111. The top wall segment 118*a* of the lower portion 112 provides a baffle preventing the substantial bypassing of gas evolved from the disinfectant tablet from the lower portion 112 to the upper portion 114.

The cross-sectional area of the baffle 118*a* may be adjusted, depending upon the degree of gas evolution. However, decrease in the cross-sectional area of the baffle 118*a* preferably is obtained by reducing the longitudinal dimension of the baffle, rather than the transverse dimension of the baffle. In the dispenser shown in FIG. 2, the baffle may be a wall segment common to both the lower portion 112 and the upper portion 114. However, the particular construction shown in FIG. 2 wherein the baffle 118*a* and wall segment 118*b* are separate and join proximate the backing substrate is more suitable for fabrication by thermoforming.

Figure 4:
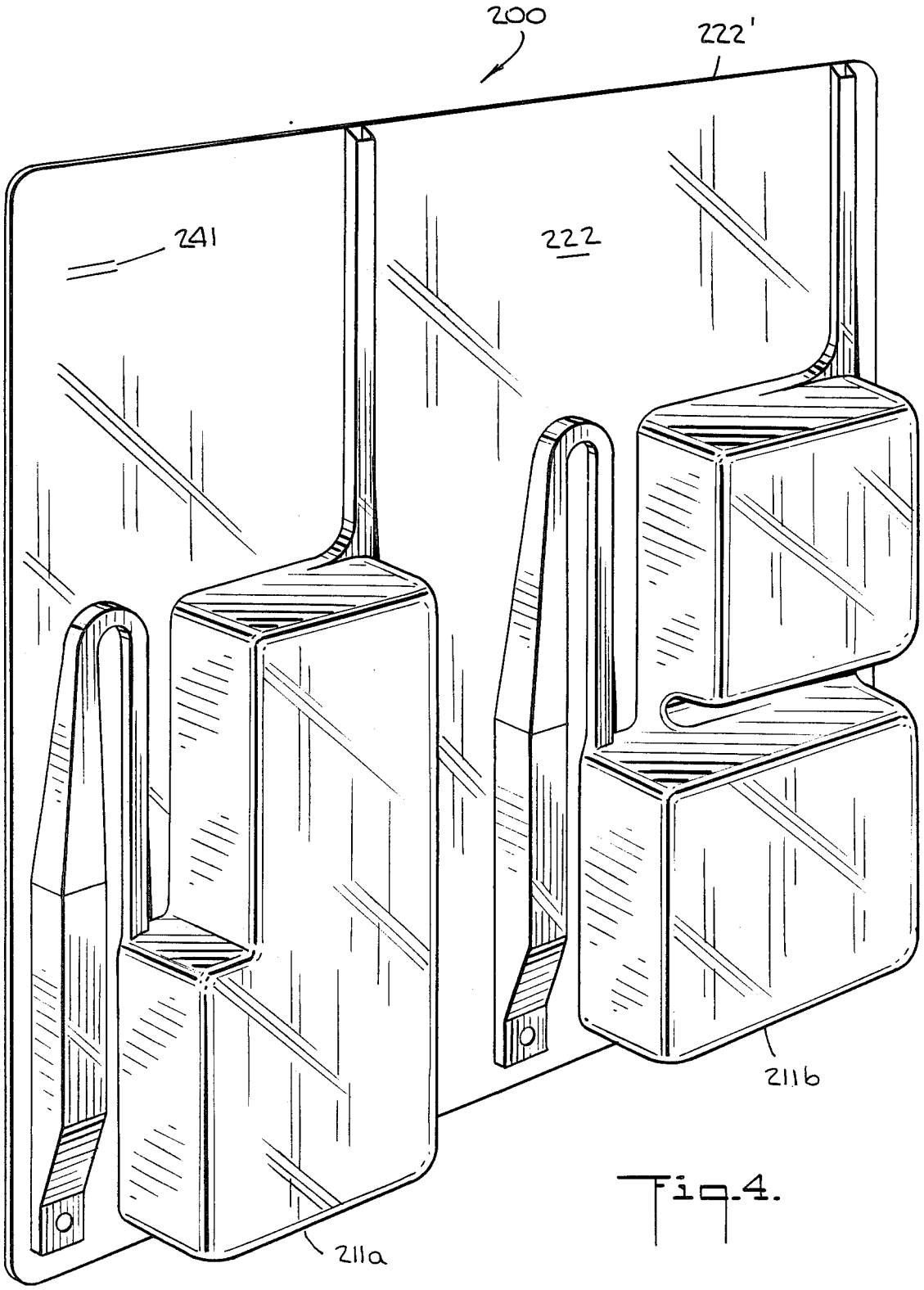
FIG. 4 is a perspective view of a dual chamber dispenser for separately dispensing a first cleaning solution and a second cleaning solution, which is the disinfectant solution.

The refill/discharge pathway 130 shown in FIG. 2 is the same as that shown in FIG. 1 for dispenser 10. Similarly, the vent conduit 140 is the same as that shown in FIG. 1 for dispenser 10. FIG. 4 illustrates a dispenser 200 adapted for releasing into the tank water simultaneously from separate product chambers 211*a* and 211*b* a first cleaning solution and a second cleaning solution, said first cleaning solution being a detergent solution and the second cleaning solution being the disinfectant solution. Product chamber 211*a* containing the detergent composition, is the same as shown in FIG. 1. However, detergent compositions generally do not evolve gaseous by-products in aqueous solution, and it is not critical that the product chamber containing the detergent composition have the construction disclosed herein. Product chamber 211*b* is the same as that shown in FIG. 2.

Typically, the dispenser of the present invention releases active disinfectant solution for a period of from about 20 to about 40 days, depending on the level of use thereof. On average, the dispenser releases the disinfectant solution for a period of 30 days, based upon an average of from about 8 to 12 flushes per day. Thus, the volume of the product chamber is preferably from about 65 to about 85 ml, the upper portion of the product chamber being from about 45 to about 75 ml, the solution released by the dispenser being contained in said upper portion. The disinfectant material weighs typically between about 25 to about 45 grams active disinfectant material, and is preferably in tablet form. The tablet is about 1½ inches diameter by about ½ inch in thickness.

A typical dispenser as shown in FIG. 2 has a lower portion that is about 2½ inches high by 2-11/16 inches wide by about 1 inch deep, and an upper portion that is about 2 inches high by about 2⅛ inches wide by about 1 inch deep. The elongate pathway between the upper portion and the lower portion is about 3/16 inch in width, measured normal to the backing substrate.

The shoulder of the dispenser illustrated in FIG. 2 i.e. that area where the upper portion does not overlie the lower portion may be slightly raised in the direction of the refill/discharge pathway, thereby assuring that the evolved gases are collected in the refill/discharge pathway. Similarly, the top wall 20 or 120 of the upper chamber may be directed slightly upwardly towards the vent conduit 40 or 140, respectively, thereby directing evolved gases out of the product chamber.

The dispenser of FIG. 1 containing various disinfectant materials was tested to ascertain the concentration of disinfectant material in the tank water. The test was conducted by placing identical units in separate toilet tanks, and measuring the concentration of disinfectant material as available chlorine proximate the outlet orifice 33 of the refill/discharge pathway 30, for various disinfectant materials. The tanks were not flushed during the test period. Concentration proximate the outlet orifice 33, under these static conditions, is the maximum concentration in the tank water. The results are shown in Table I.

TABLE I

| Disinfectant | Concentration (ppm available chlorine) 7 days | 14 days | 20 days |
|---|---|---|---|
| TCICA | 3.7 | 27 | 30 |
| BCDMH | 0.2 | 0.8 | 0.4 |
| DBDMH | 11 | 7.9 | 20 |
| Calcium Hypochlorite | 2.6 | 1.3 | 0.5 |
| Sodium Dichlorocyanurate | 423 | Discontinued | Discontinued |

TABLE I-continued

| Disinfectant | Concentration (ppm available chlorine) 7 days | 14 days | 20 days |
|---|---|---|---|
| Potassium Dichlorocyanurate | 30 | 70.5 | 101 |

Referring to Table I, it is seen that the two dichlorocyanurate salts, which have not been observed to evolve gases, particularly sodium dichlorocyanurate, are less effective in preventing the buildup of available chlorine in the tank water. Gas was seen to collect in the upper portion of the inlet/discharge conduit for the dispensers containing trichloroisocyanuric acid (TCICA), bromochlorodimethylhydantoin, dibromodimethylhydantoin, and calcium hypochlorite.

The dispenser of FIG. 2 containing a 28 gram trichloroisocyanuric acid tablet was tested over a 31 day period. A dispenser was placed (after priming) in each of four tanks, each tank containing 14 liters of city tap water. Water samples were taken and analyzed periodically to determine available chlorine concentrations, the samples being taken two inches from the bottom of the tanks proximate the overflow pipe and flush valve. The tanks were not flushed during the test. The results are tabulated in Table II.

TABLE II

| Time (Days) | Average Concentration (ppm available chlorine) |
|---|---|
| 1 | 1.5 |
| 3 | 1.4 |
| 4 | 1.06 |
| 8 | 2.85 |
| 10 | 4.22 |
| 12 | 5.65 |
| 14 | 9.25 |
| 17 | 13.12 |
| 18 | 15.62 |
| 19 | 16.25 |
| 24 | 14.37 |
| 26 | 15.31 |
| 31 | 19.06 |

Gas was seen to accumulate in the inlet discharge conduit of each dispenser.

I claim:

1. An in-tank toilet dispenser adapted to dispense a disinfectant aqueous solution into a toilet when the toilet is flushed, the dispenser comprising:

(a) a product chamber containing a disinfectant agent that releases as a function of time gaseous by-products form said aqueous solution, the product chamber having a lower portion and an upper portion;

(b) baffle means normal to the vertical plane of the product chamber and separating said lower and upper portions, there being a channel for fluid communication between said lower and upper portions in the vicinity of said baffle means;

(c) the cross-sectional area of the lower portion in a plane horizontal thereto being larger than a similar cross-section of the upper portion thus forming a shoulder at the interface of said portions;

(d) an inlet/outlet pathway in the form of an inverted U-shaped conduit having an exterior leg and an interior leg, the uppermost portion thereof wherein the legs are joined being arcuate in shape and having a volume of less than 0.50 cubic centimeter, gaseous by-product collecting in said uppermost portion during the time period between two flushes of the toilet to isolate the lower chamber from ambient, said conduit being in fluid communication with said lower portion at the shoulder of the product chamber, where said upper portion does not overlie said lower portion, the cross-sectional area of the interior leg normal to flow being less than that of the exterior leg; and (e) vent means proximate the top of the upper portion of the product chamber.

2. The dispenser of claim 1 wherein the exterior leg of the pathway is longer than the interior leg.

3. The dispenser of claim 2 wherein the exterior leg comprises a lower portion, an intermediate portion of greater volume, and an upper portion, the cross-sectional area normal to flow thereof decreasing gradually toward the interior leg.

4. The dispenser of claim 3 wherein the volume of the uppermost portion of the inlet/outlet pathway is less than about 0.25 cubic centimeter.

5. The dispenser of claim 4 wherein the accumulation of available chlorine in the tank is less than about 30 ppm during the life of the dispenser.

6. The dispenser of claim 5 wherein the cross-sectional area of the path between the upper and lower portions available for fluid communication therebetween is about 18.75% of the cross-sectional area of the baffle.

7. The dispenser of claim 6 wherein the uppermost portion of the U-shaped conduit has a volume of less than about 0.25 cubic centimeter.

8. The dispenser of claim 1 or 5 wherein the disinfectant is 1-bromo-3-chloro-5,5-dimethylhydantoin.

9. The dispenser of claim 1 or 5 wherein the disinfectant is trichloroisocyanuric acid.

10. The dispenser of claim 9 wherein the disinfectant is two to four parts trichloroisocyanuric acid and one part cyanuric acid.

11. The dispenser of claim 1 wherein the area of the shoulder is from about 10% to about 90% of the area for fluid communication between the upper portion and the lower portion.

12. The dispenser of claim 1 or 4 wherein the disinfectant is selected from the group consisting of halogenated hydantoins, trichloroisocyanuric acid, and inorganic hypochlorite salts of calcium, lithium, and magnesium.

13. The dispenser of claim 1 or 5 wherein the disinfectant is calcium hypochlorite.

14. The dispenser of claim 1 further comprising a second product chamber having means for inlet and outlet of liquid and further having vent means proximate the top thereof.

* * * * *